US010406660B2

(12) United States Patent
Hale et al.

(10) Patent No.: US 10,406,660 B2
(45) Date of Patent: Sep. 10, 2019

(54) FASTENER DRIVING SYSTEM

(71) Applicant: Simpson Strong-Tie Company, Inc., Pleasanton, CA (US)

(72) Inventors: Troy Hale, Goodlettsville, TN (US); Clark Allen, Smyrna, TN (US)

(73) Assignee: Simpson Strong-Tie Company, Inc., Pleasanton, CA (US)

( * ) Notice: Subject to any disclaimer, the term of this patent is extended or adjusted under 35 U.S.C. 154(b) by 146 days.

(21) Appl. No.: 15/369,622

(22) Filed: Dec. 5, 2016

(65) Prior Publication Data

US 2017/0157756 A1 Jun. 8, 2017

Related U.S. Application Data

(60) Provisional application No. 62/262,851, filed on Dec. 3, 2015.

(51) Int. Cl.
*B25B 21/00* (2006.01)
*B25B 23/04* (2006.01)

(52) U.S. Cl.
CPC ..... *B25B 23/045* (2013.01); *B25B 21/00* (2013.01)

(58) Field of Classification Search
CPC ..... B25B 23/045; B25B 21/00; B25B 23/06; B25B 23/04; F16B 27/00
See application file for complete search history.

(56) References Cited

U.S. PATENT DOCUMENTS 3,642,039 A * 2/1972 McGee ..... B25B 21/00 192/57
5,337,635 A 8/1994 Habermehl
5,927,163 A 7/1999 Habermehl et al.
6,089,132 A 7/2000 Habermehl
6,363,818 B1 4/2002 Habermehl
6,439,085 B1 8/2002 Habermehl et al.
(Continued)

FOREIGN PATENT DOCUMENTS

EP 2152473 A1 2/2010
EP 2152473 B1 8/2016

OTHER PUBLICATIONS

International Search Report and the Written Opinion dated Mar. 28, 2017 in International Application No. PCT/US2016/064994 filed Dec. 5, 2016.

(Continued)

*Primary Examiner* — Robert J Scruggs
(74) *Attorney, Agent, or Firm* — Vierra Magen Marcus LLP

(57) ABSTRACT

A positioning assembly for a driving system, the assembly having a first jaw and a second jaw, the first jaw fixed to a driver guide tube, the second jaw fixed to the first jaw to allow one end of the first jaw to rotate away from the second jaw about a connection point, each jaw having an interior channel. The interior channel of the first jaw has an arcuate cross-section. The interior channel of the second jaw is formed from a plurality of walls including an arcuate upper wall and a sub-channel having cross-section formed by a base surface and two side walls, each side wall angled with respect to the base surface. The apparatus also includes a locking member configured to engage the second jaw when the second jaw is rotated away from the first jaw and retain the second jaw in a rotated position.

17 Claims, 25 Drawing Sheets

(56) References Cited

U.S. PATENT DOCUMENTS

| | | | |
|---|---|---|---|
| 6,862,963 | B2 | 3/2005 | Habermehl |
| 6,941,847 | B2 | 9/2005 | Habermehl et al. |
| 6,959,630 | B2 | 11/2005 | Habermehl et al. |
| 2004/0139822 | A1 | 7/2004 | Gehring et al. |

OTHER PUBLICATIONS

International Preliminary Report on Patentability and Written Opinion dated Jun. 14, 2018, in International Application No. PCT/US2016/064994 filed Dec. 5, 2016.

* cited by examiner

X
210A
870
884
860

805
415
850
855
840
860
884
880
820
830
882

214
212
210A
865
415
805
855
850
860
840
884
880
12A
13A
13A
12A
870
820
830
882

220B

220B 904
902
220B
212
19B
19B
20B
20B
18B
18B

220B

FASTENER DRIVING SYSTEM

CLAIM OF PRIORITY

The present application claims priority to provisional patent application No. 62/262,851, entitled, "FASTENER DRIVING SYSTEM", to Hale et al., which application was filed on Dec. 3, 2015 and which application is incorporated by reference herein in its entirety.

BACKGROUND

Power fastener drivers for driving collated fastener strips have a number of uses in the construction industry. Examples of such power drive fastener drivers are shown in include U.S. Pat. No. 5,568,753 to Habermehl, issued Oct. 29, 1996; U.S. Pat. No. 5,870,933 to Habermehl, issued Feb. 16, 1999, U.S. Pat. No. 5,570,618 to Habermehl et al., issued Nov. 5, 1996 and U.S. Pat. No. 6,862,963 issued Mar. 8, 2005. Additional examples of such systems are commercially available under the name QuikDrive® from Simpson Strong Tie Inc, Pleasanton, Calif.

Certain types of powered fastener drivers utilize an automatic feed fastener driver in which a housing is secured to a power driver. The housing includes a fastener feed channel to receive the fastener strips holding a plurality of fastener s. The fastener s held in the fastener strips are advanced sequentially to a point where each successive fastener to be driven is coaxially arranged within a bore of a guide tube in line with a driver shaft. Pressure applied by the user in conjunction with the application of power to the driver allows the fastener to be driven into the workpiece.

Normally, the fasteners are held by the fastener strips until driven into the workpiece.

These prior art auto feed fastener drivers provide for various linkages between the driver body and the housing such that on reciprocal telescopic sliding of the slide body into and out of the housing between extended and retracted positions, the linkages cause automatic advance of the fastener strip in the feed guide channel.

Known power driven systems generally have an open end though which the fasteners advance into the work piece. In certain applications, greater accuracy than available using current power driven fastener drivers is required. Installers may need to find a particular pre-drilled hole. Currently, users place a fastener gun over the hole and "hope for the best."

SUMMARY

The technology provides a guide assembly for an apparatus for driving a threaded fastener. The apparatus may include: a driver guide tube having a first end, and an elongated driver shaft in the guide tube having a rear end coupled to a power driver and a forward end carrying a bit, the driver shaft defining a longitudinal axis. The positioning assembly has a first jaw and a second jaw, the first jaw fixed to the driver guide tube, the second jaw fixed to the first jaw to allow one end of the first jaw to rotate away from the first jaw about a connection point. Each jaw has an interior channel, the interior channel of the first jaw and the second jaw forming a guide channel. The apparatus also includes the interior channel of the first jaw having an arcuate cross-section. The apparatus also includes the interior channel of the second jaw formed from a plurality of walls including an arcuate upper wall formed at an angle relative to the longitudinal axis, a sub-channel having cross-section formed by a base surface and two side walls, each side wall angled with respect to the base surface.

Another aspect includes an apparatus for driving a threaded fastener, including: a driver guide tube having a first end; an elongated driver shaft in the guide tube having a rear end coupled to a power driver and a forward end adapted to carry a bit, the driver shaft defining a longitudinal axis; a positioning assembly having a first jaw and a second jaw, the first jaw fixed to the driver guide tube, the second jaw fixed to the first jaw to allow one end of the first jaw to rotate away from the first jaw about a connection point, each jaw having an interior channel. The apparatus also includes a locking member configured to engage the second jaw when the second jaw is rotated away from the first jaw and retain the second jaw in a rotated position.

A further aspect includes a positioning assembly for a driving system, the assembly having a first jaw and a second jaw, the first jaw fixed to the driving system, the second jaw fixed to the first jaw to allow one end of the first jaw to rotate away from the first jaw about a connection point, each jaw having an interior channel. The interior channel of the first jaw has an arcuate cross-section. The apparatus also includes the interior channel of the second jaw formed from a plurality of walls including an arcuate upper wall formed at an angle relative to the longitudinal axis, a sub-channel having cross-section formed by a base surface and two side walls, each side wall angled with respect to the base surface. The apparatus also includes a locking member configured to engage the second jaw when the second jaw is rotated away from the first jaw and retain the second jaw in a rotated position.

BRIEF DESCRIPTION OF THE DRAWINGS

FIGS. 3A-23A illustrate various parts of a first embodiment of a guide assembly.

FIG. 3B-23B illustrate various parts of a second embodiment of a guide assembly.

FIG. 3A is a plan view of a first embodiment of a first positioning jaw.

FIG. 3B is a plan view of a second embodiment of a first positioning jaw.

FIG. 3C is an enlarged view of the jaw in FIG. 3A.

FIG. 4A is a first side view the first embodiment of a first positioning jaw.

FIG. 23A is a cross-sectional view along line 23A-23A in FIG. 21A.

FIG. 23B is a cross-sectional view along line 23B-23B in FIG. 21B.

DETAILED DESCRIPTION

A power driven fastener driving system is provided that increases the accuracy of fastener placement for an installer. A positioning assembly on the driving system ensures that the fastener will exit the driver and enter the work piece at the location where the positioning assembly abuts the work piece and along an axis defined by a drive shaft of the driving system. A spring-loaded jaw moves under the advancement of fasteners in a fastener strip to receive a fastener and retain the fastener in an accurate position while being driven into a workpiece. The system includes a positioning assembly with a unique interior channel configuration and a locking member ensuring that the jaws of the positioning assembly remain open when the fastener is inserted into the assembly.

Figure 1:
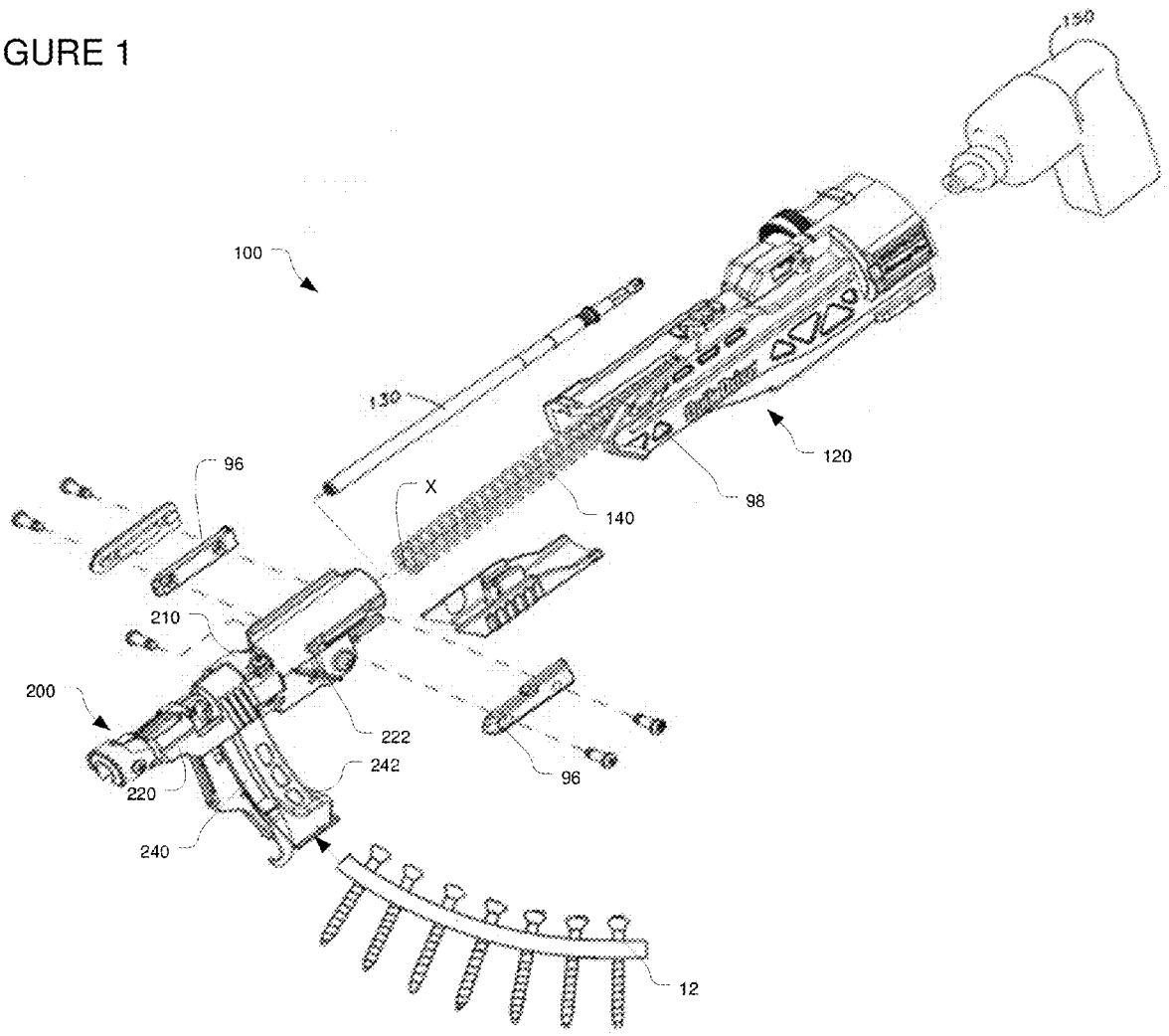
FIG. 1 is a perspective, exploded view of a guide tool assembly used in conjunction with an extension assembly.

FIG. 1 shows an exploded, perspective view of the driving system 100. The driving system 100 includes a power driver 150, extension assembly 120 and positive placement, guide tube assembly 200. The driving system 100 is adapted for use with a number of commercially available power drivers 150. As shown in FIG. 1, and as known to one skilled in the art, a mandrel assembly 130 and return spring 140 are positioned within extension assembly 120 and positive placement guide tube assembly 200 to advance a rotating and reciprocating bit driven by the power driver 150 to drive fasteners into a work piece. The extension assembly 120 includes a housing which contains the mandrel 130, spring 140 and a driving bit (not shown). The mandrel 130 and driving bit enter the guide tube assembly 200 to eject fasteners from the system 100. The guide tube assembly 200 is attached to the extension assembly 120 by shuttle brackets 96, which are fastened to bores in the guide tube assembly and pass through first and second slots 98 (only one of which is shown in FIG. 1) on a first and second side of the extension assembly 120.

The driving system 100 is designed to drive fasteners comprising fastener s provided in a fastener strip. The fastener strips 12 hold the fasteners connected to each other by a retaining belt generally made of plastic material. Fasteners in such strips 12 are engaged by a bit of a fastener driver and then fastened (or screwed) into a workpiece. In the course of the bit or mandrel 130 engaging the fastener and/or driving the same into the workpiece, the fastener becomes detached from the plastic strip 12. The fastener strips 12 are fed into an engagement channel in the guide tube assembly 200 by two guide rails 240, 242 which form a feed channel extending radially from the placement assembly 200.

Fasteners carried by such strips are adapted to be successively incrementally advanced to a position in alignment with a reciprocating, rotating power bit attached to the mandrel, and fastened into a workpiece. In the strip, each fastener to be driven has its threaded shaft engaged in a threaded sleeve of the strip such that on the fastener driver engaging and rotating each successive fastener, the fastener turns within the sleeve which acts to guide the fastener as it moves forwardly into threaded engagement into the workpiece. Further forward movement of the fastener into the workpiece then draws the head downward to engage the sleeve and rupture the sleeve by reason of the forward movement of the head with the strip retained against movement towards the workpiece. Advancing the strip with each successive fastener to be driven results in portions of the strip from which each fastener has been driven are advanced to exit from the driving system.

Driving of fastener s in this manner is well known in the art and generally illustrated in U.S. Pat. Nos. 6,164,170 and 6,862,963. In tool 100, the mandrel and driving bit are aligned on an axis extending the length of the mandrel. The axis extends though the work piece and defines the position where the fastener will enter the work piece. The axis X may be referred to herein as the longitudinal axis.

The present technology provides improved placement and securing of the fastener of in the placement assembly.

Figure 2A:
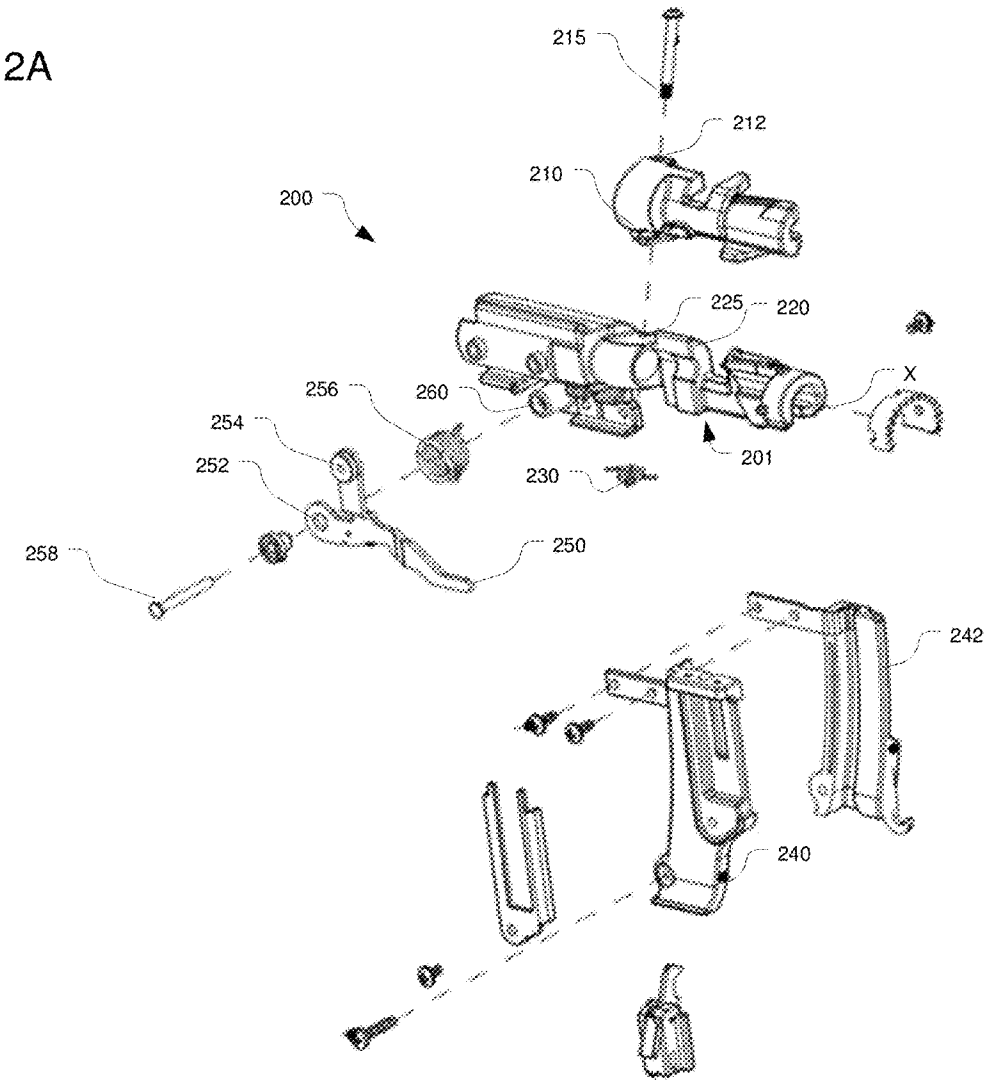
FIG. 2A is a partially exploded perspective view of the guide assembly for the guide tool shown in FIG. 1.
Figures 3A, 3C, 4A:
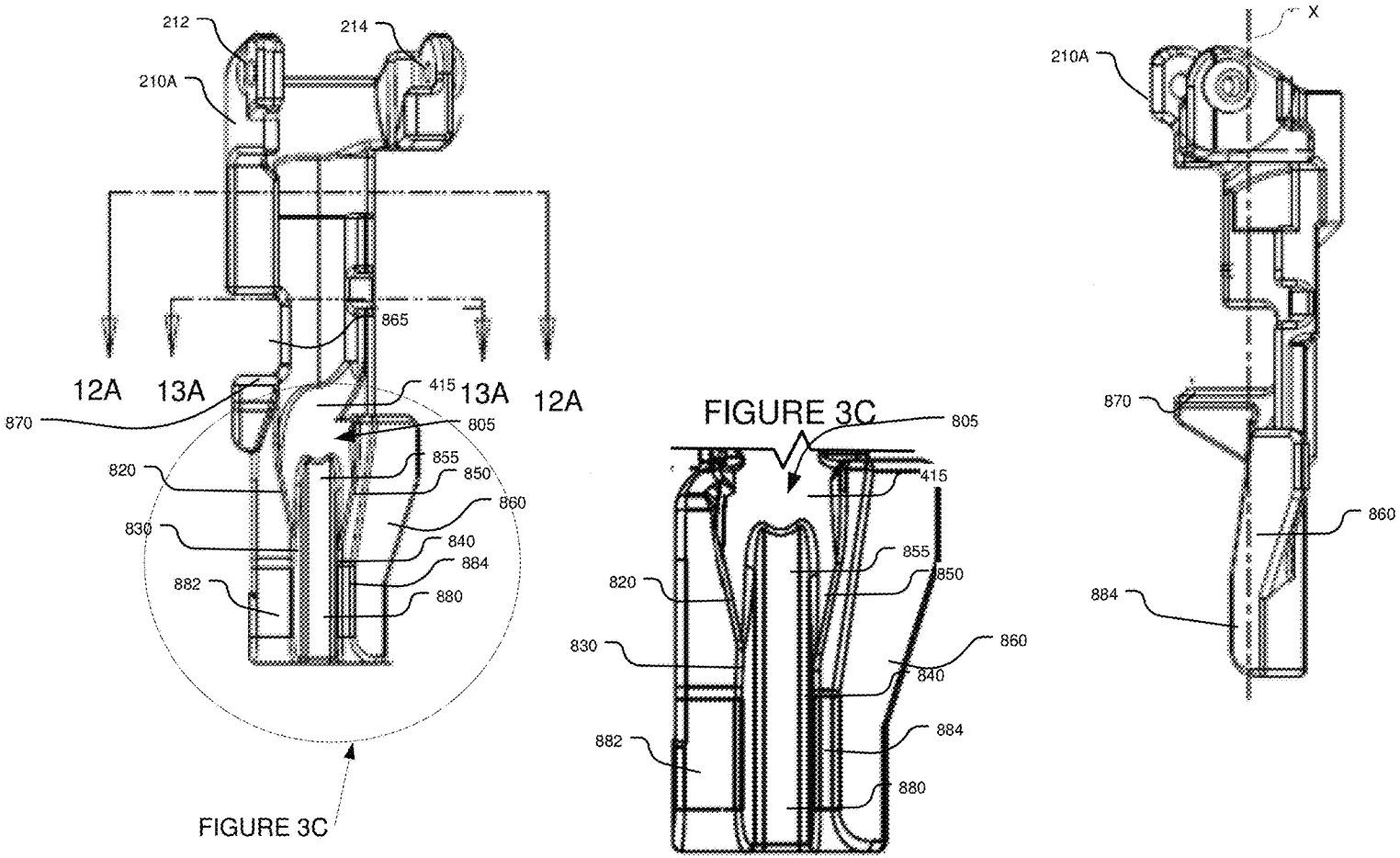
Figure 4B:
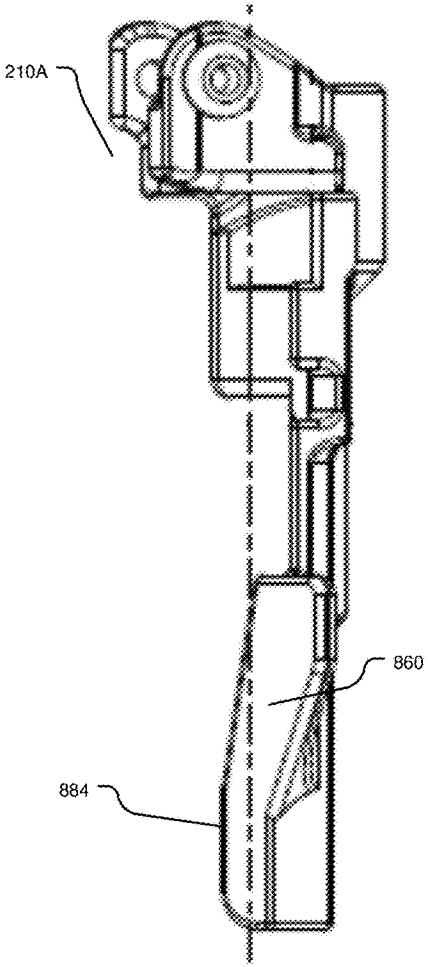
FIG. 4B is a first side view the second embodiment of a first positioning jaw.

FIG. 2 is an exploded, perspective view of the guide tube subassembly 200 of the driving system 100. With reference to FIGS. 1 through 3, the guide tube assembly 200 is adapted to receive a collated fastener strip 12.

The guide tube assembly 200 includes two positioning jaws 210, 220 which are mounted in opposing fashion to one end of the guide tube placement assembly 200. One positioning jaw 220 is molded to a mounting structure 222 and remains fixed while an opposing jaw 210 rotates outward to allow fasteners to enter a placement channel in the guide tube assembly 200. As discussed below, two embodiments the positioning jaws (designated with "A" and "B) are shown herein, with the primary difference between the two embodiments being the location of a collation shelf 870, 970 on either jaw 210A or 220B. Like numbers are used to designate like elements in both embodiments. It should be understood that where reference to a part number does not include a designation "A" or "B", both part embodiments may be used equally. (For example, a reference to jaw 210 without specific reference to the embodiment of 210A or 210B means that either part may be used.)

In the embodiment of FIGS. 3A-23A, the collation shelf is formed on jaw 210A. In the second embodiment illustrated in FIGS. 3B-23B, the collation shelf 970 is positioned on jaw 220B rather than on jaw 210B.

Generally, jaw 210 is mounted to jaw 220 by a pin 215 secured in bore 212, 214 of jaw 210 and bore 225 of jaw 220. A coil spring 230 is positioned adjacent each jaw and has a first portion abutting the jaw 210 and a second portion abutting the jaw 220. Spring 230 maintains jaw 210 engaged to jaw 220 with tension provided by the spring, the tension having sufficient force to maintain engagement but also allow a fastener on a fastener strip passing through fastener strip guides 240, 242 into the open jaws to receive the fastener between the jaws.

A feed carrier assembly advances fastener s in the carrier in a manner shown in U.S. Pat. No. 6,164,170. A lever 250 is pivotally mounted to arm 225 by pin 258 engaging bore 252 in lever 250 and bore 256 in arm 225. The lever 250 pivots about pivoting an axis of ping 258 which passes centrally through the pin 258. A spring 256 engages the lever 250 and arm 225 to bias the lever upward toward a position where lever 250 is generally parallel with the fastener channel in the assembly 200. A sub-lever 254 allows lever 250 to be attached to a controlling mechanism on extension assembly 120 to rotate the lever about the axis. The forward end of lever 250 is adapted to engage the fastener strip 12 and with movement of the shuttle 96 causes the lever to successively advance the strip one fastener at a time.

Figure 2B:
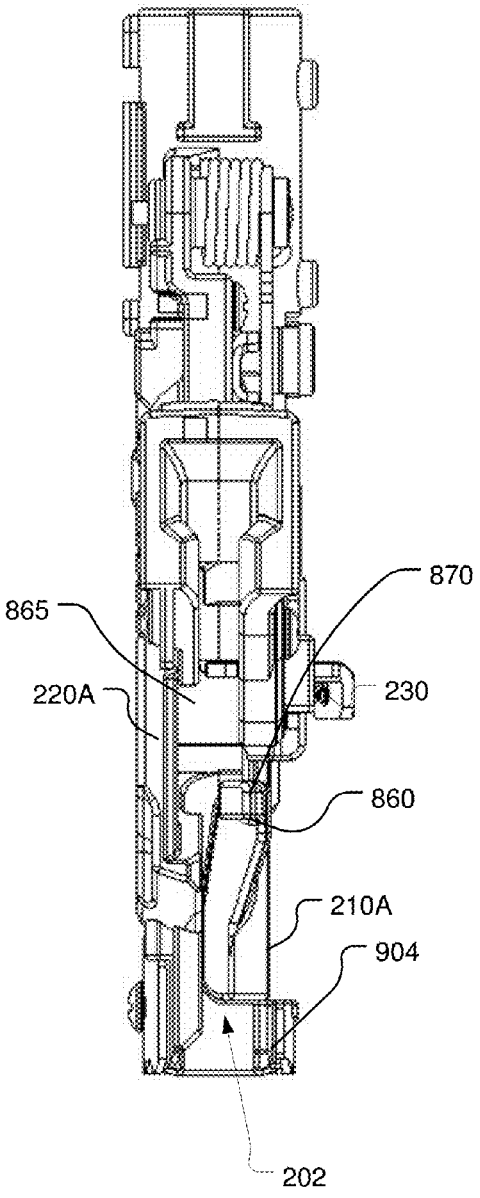
FIG. 2B is an end view of the guide positioner assembly where the jaws are in the closed position.
Figure 2C:
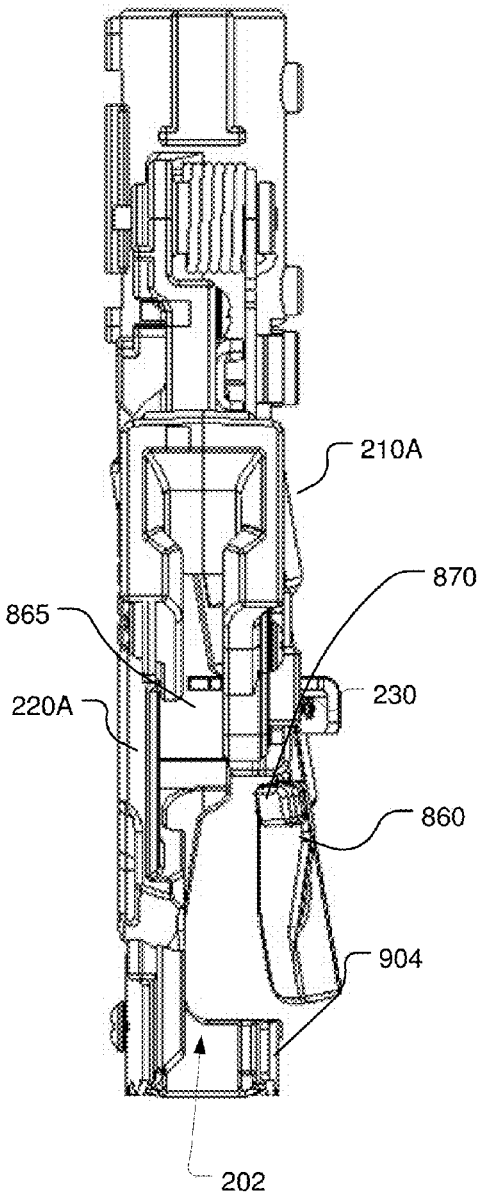
FIG. 2C is an end view of the guide positioner assembly where the jaws are in an opened position.
Figure 3B:
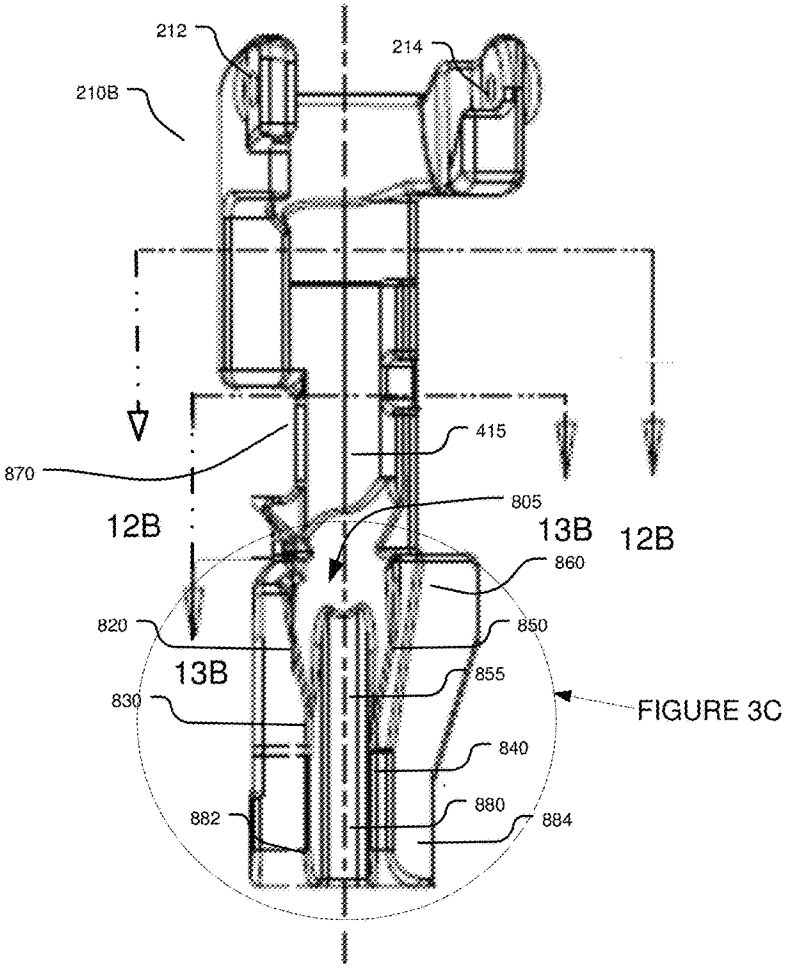
Figure 6A:
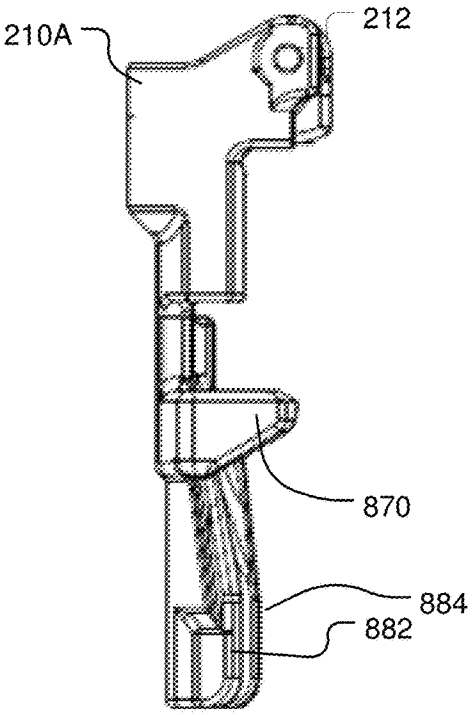
FIG. 6A is a third side view the first embodiment of a first positioning jaw.
Figure 5A:
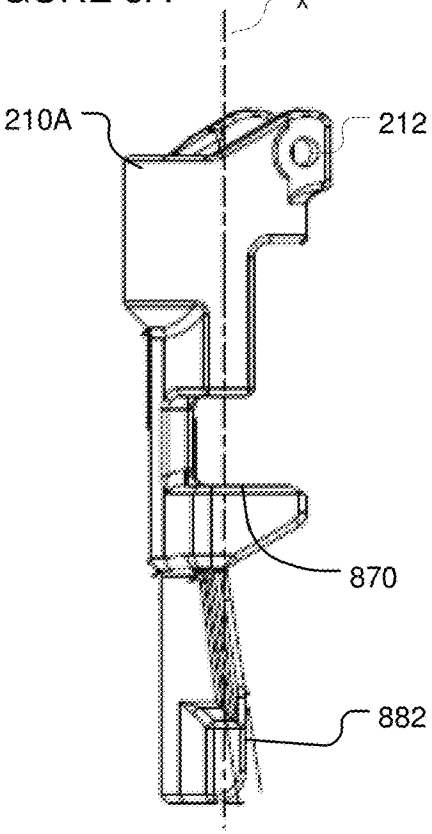
FIG. 5A is a second side view the first embodiment of a first positioning jaw.
Figure 6B:
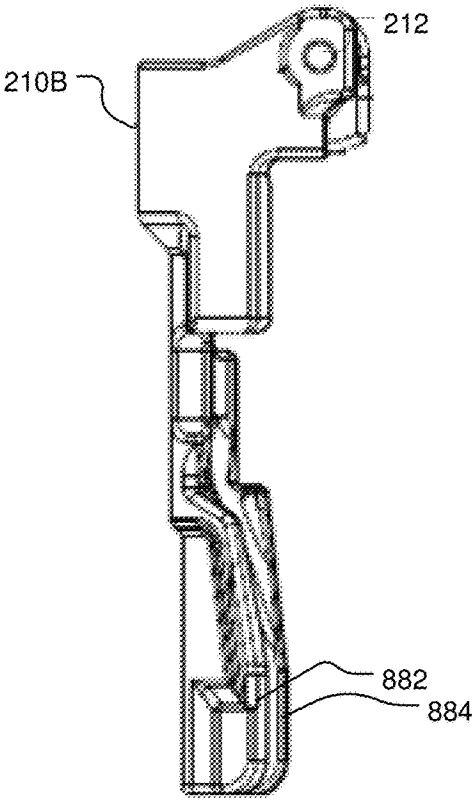
FIG. 6B is a third side view the second embodiment of a first positioning jaw.
Figure 5B:
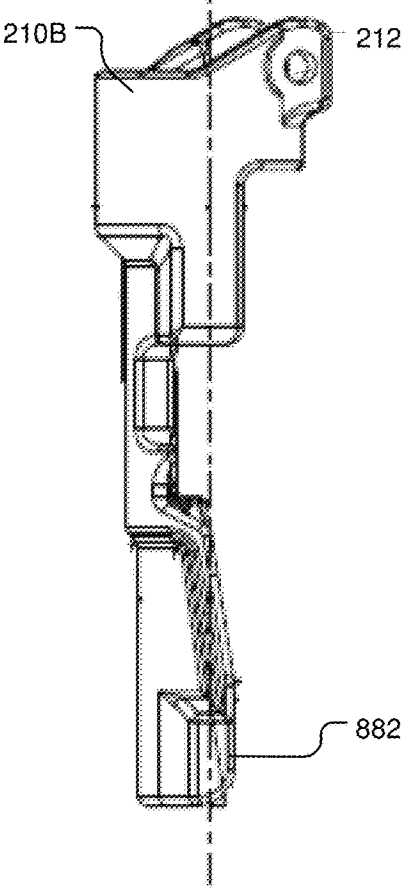
FIG. 5B is a second side view the second embodiment of a first positioning jaw.
Figure 8A:
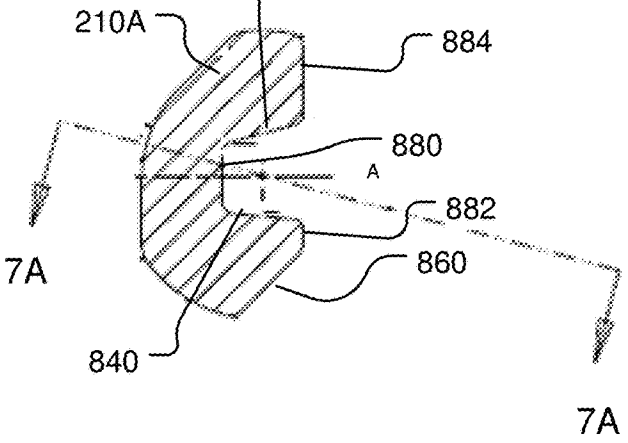
FIG. 8A is a partial cross-sectional view along line 8A-8A in FIG. 7A.
Figure 7A:
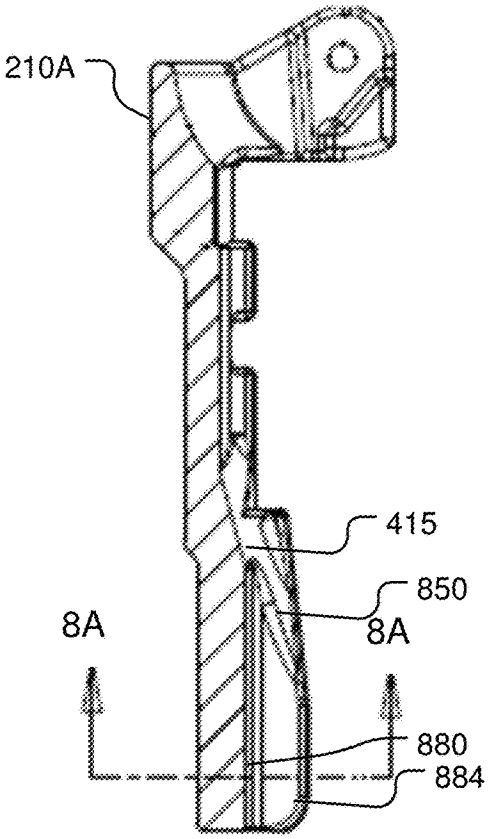
FIG. 7A is a partial cross-sectional view along line 7A-7A in FIG. 8A.
Figure 8B:
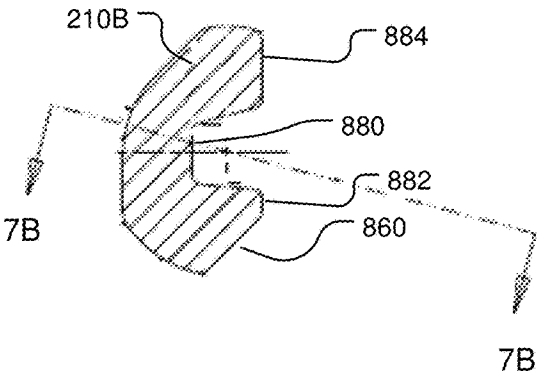
FIG. 8B is a partial cross-sectional view along line 8B-8B in FIG. 7B.
Figure 7B:
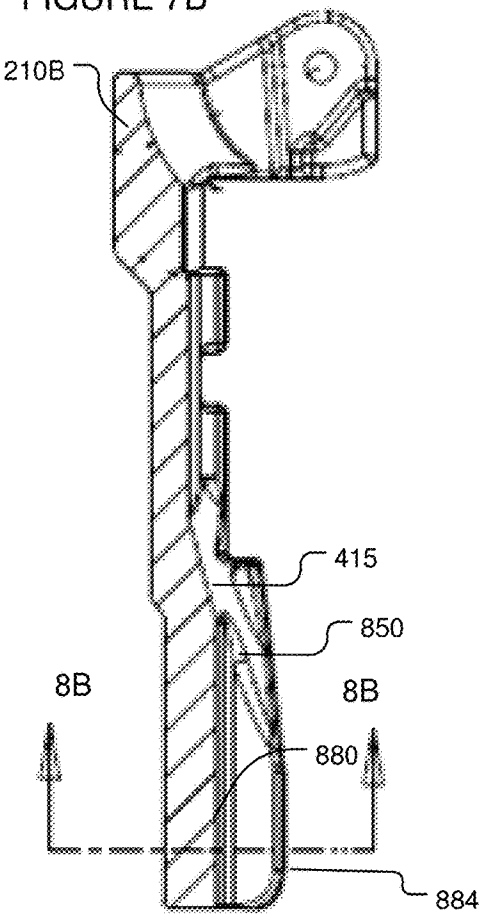
FIG. 7B is a partial cross-sectional view along line 7B-7B in FIG. 8*b*.
Figure 11A:
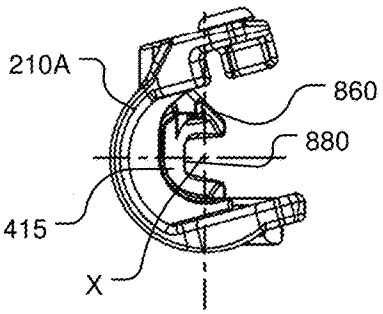
FIG. 11A is a top view of the first embodiment of a first positioning jaw.
Figure 10A:
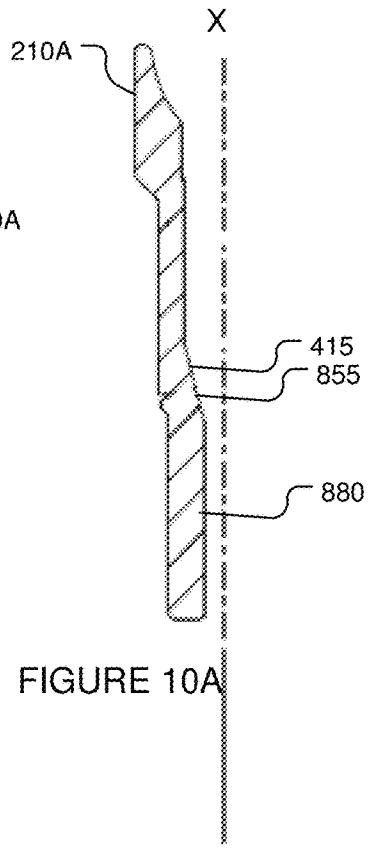
FIG. 10A is a partial cross-sectional view along line 10A-10A in FIG. 9A.
Figure 9A:
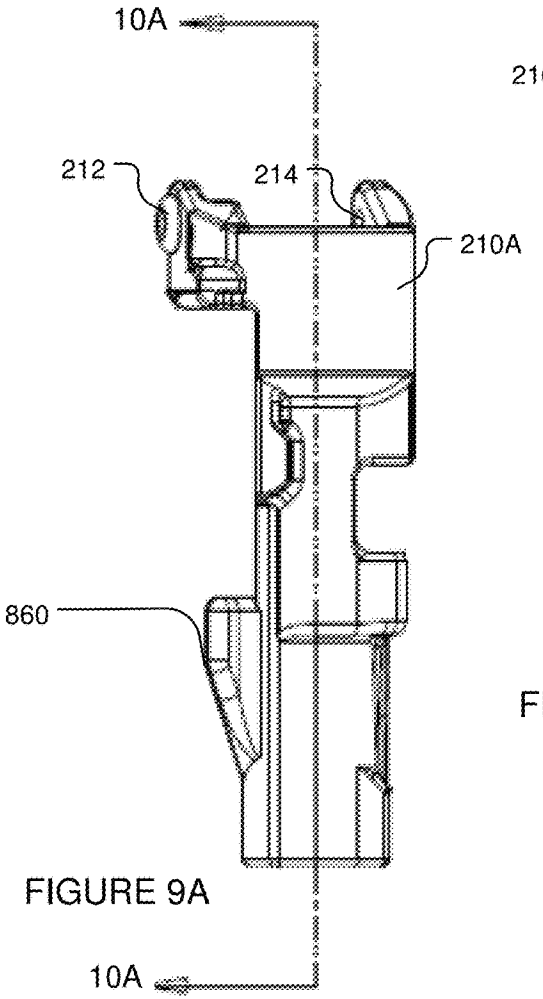
FIG. 9A is a fourth side view the first embodiment of a first positioning jaw.
Figure 11B:
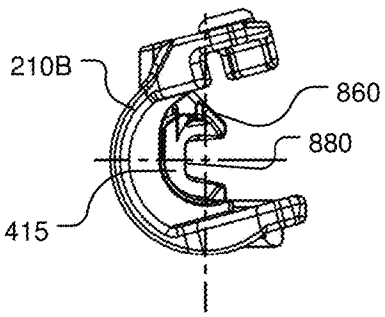
FIG. 11B is a top view of the second embodiment of a first positioning jaw.
Figure 10B:
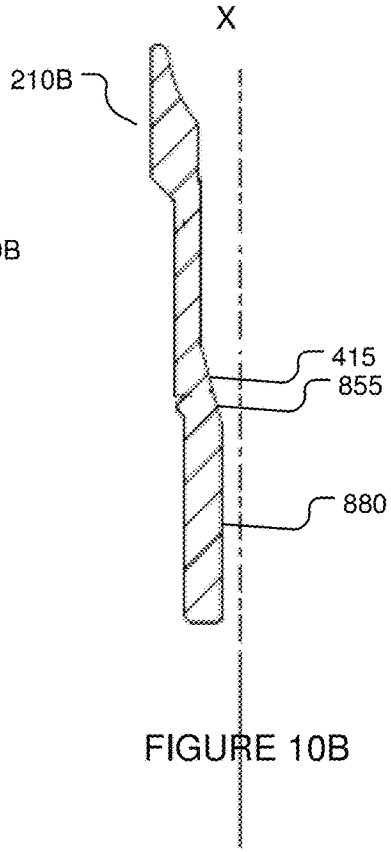
FIG. 10B is a partial cross-sectional view along line 10B-10B in FIG. 9B.
Figure 9B:
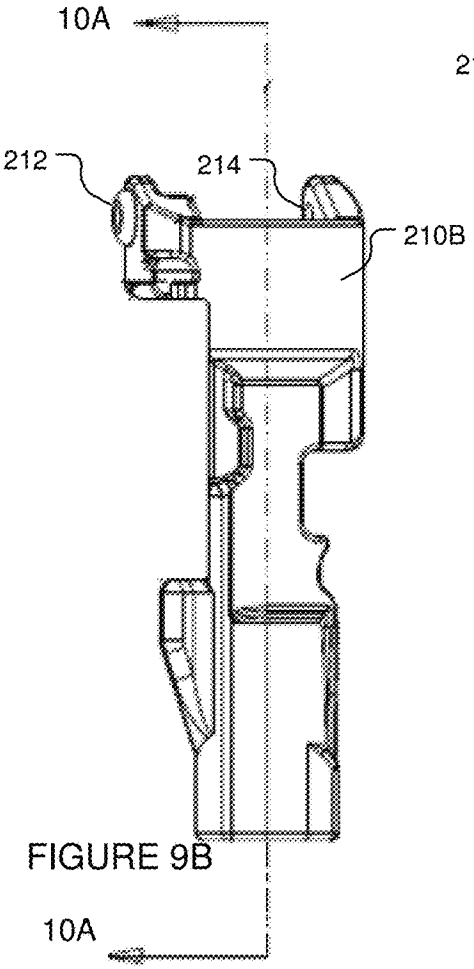
FIG. 9B is a fourth side view the second embodiment of a first positioning jaw.
Figure 13A:
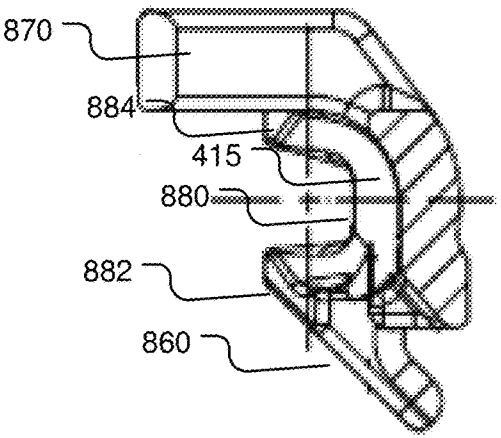
FIG. 13A is a cross-sectional view along line 13A-13A in FIG. 3A.
Figure 12A:
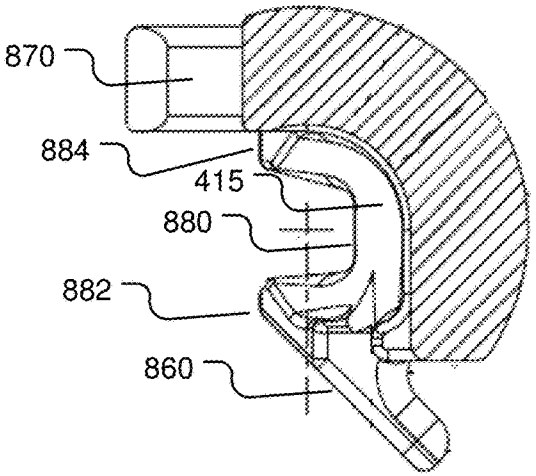
FIG. 12A is a cross-sectional view along line 12A-12A in FIG. 3A.
Figure 13B:
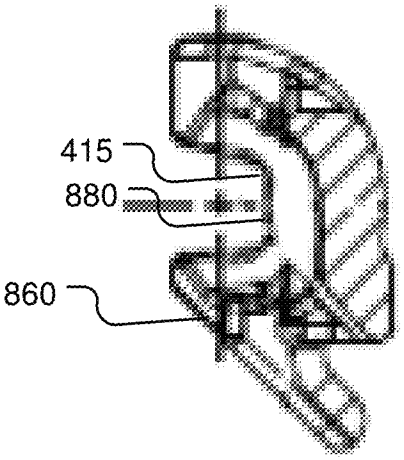
FIG. 13B is a cross-sectional view along line 13B-13B in FIG. 3B.
Figure 12B:
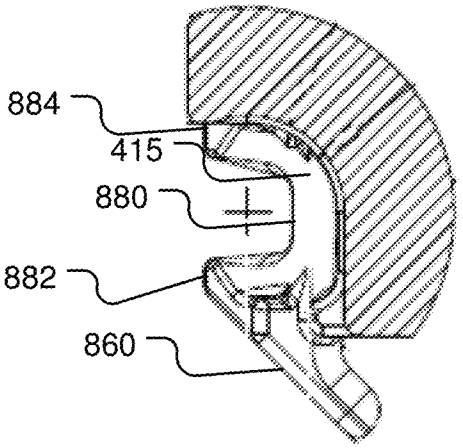
FIG. 12B is a cross-sectional view along line 12B-12B in FIG. 3B.
Figure 14A:
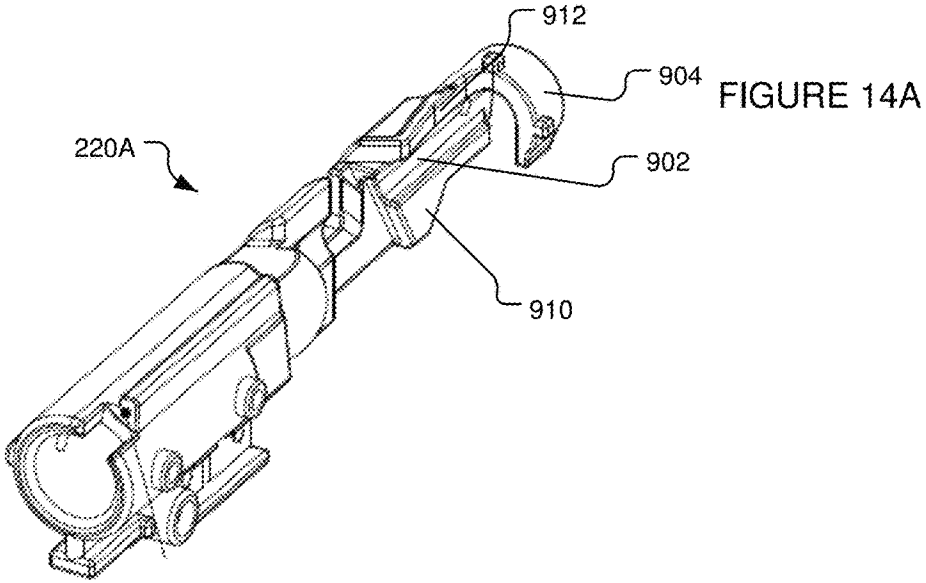
FIG. 14A is a perspective view the first embodiment of a second positioning jaw.
Figure 15A:
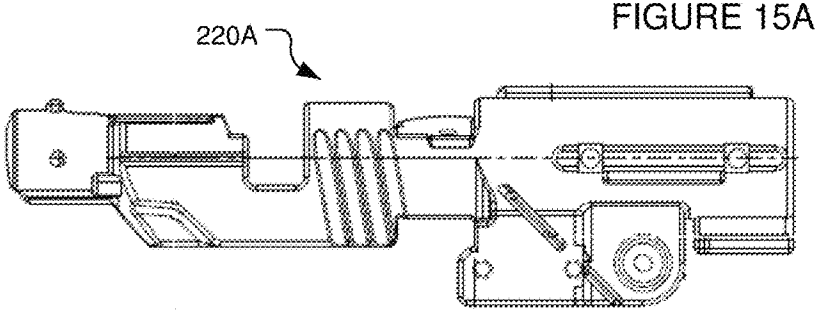
FIG. 15A is a side view the first embodiment of a second positioning jaw.
Figure 16A:
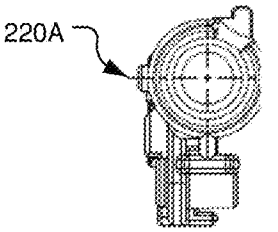
FIG. 16A is a end view the first embodiment of a second positioning jaw.
Figure 14B:
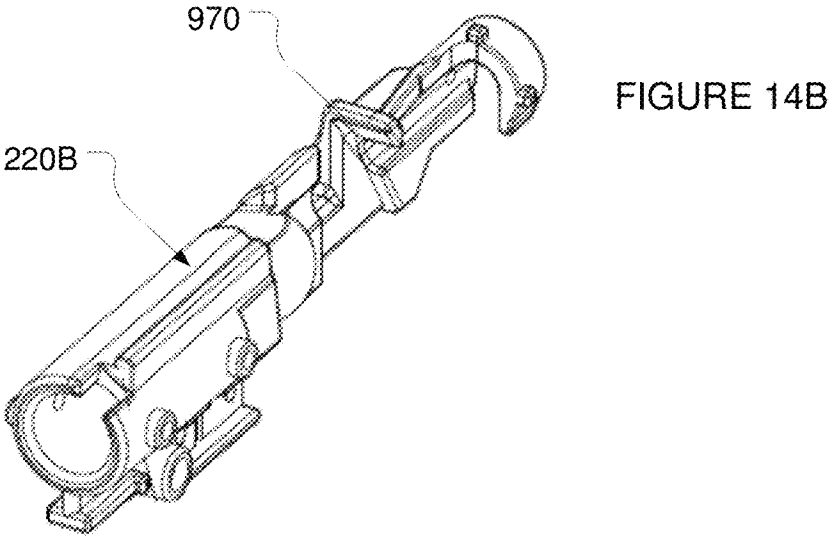
FIG. 14B is a perspective view the second embodiment of a second positioning jaw.
Figure 15B:
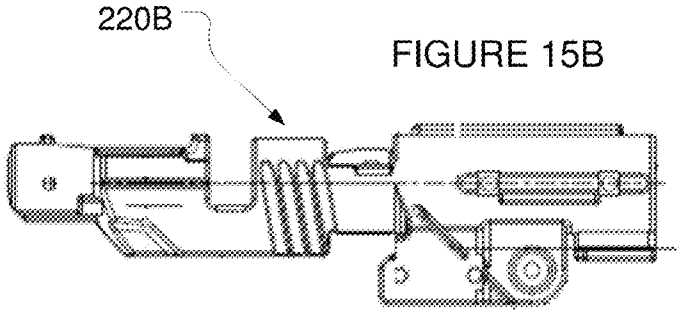
FIG. 15B is a side view the second embodiment of a second positioning jaw.
Figure 16B:
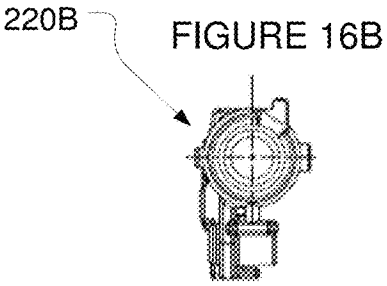
FIG. 16B is a end view the second embodiment of a second positioning jaw.
Figure 18A:
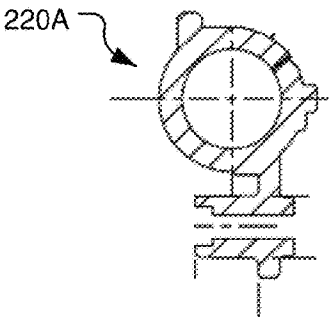
FIG. 18A is a cross-sectional view along line 18A-18A in FIG. 17A.
Figure 20A:
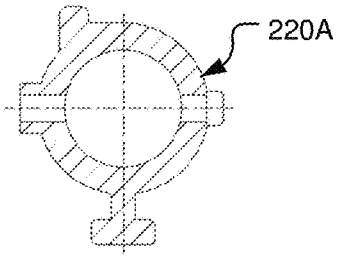
FIG. 20A is a cross-sectional view along line 20A-20A in FIG. 17A.
Figure 19A:
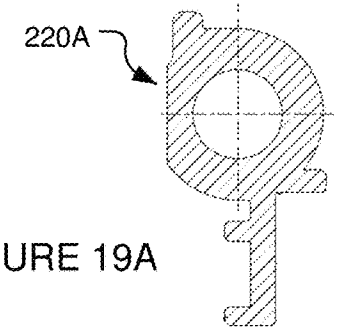
FIG. 19A is a cross-sectional view along line 19A-19A in FIG. 17A.
Figure 17A:
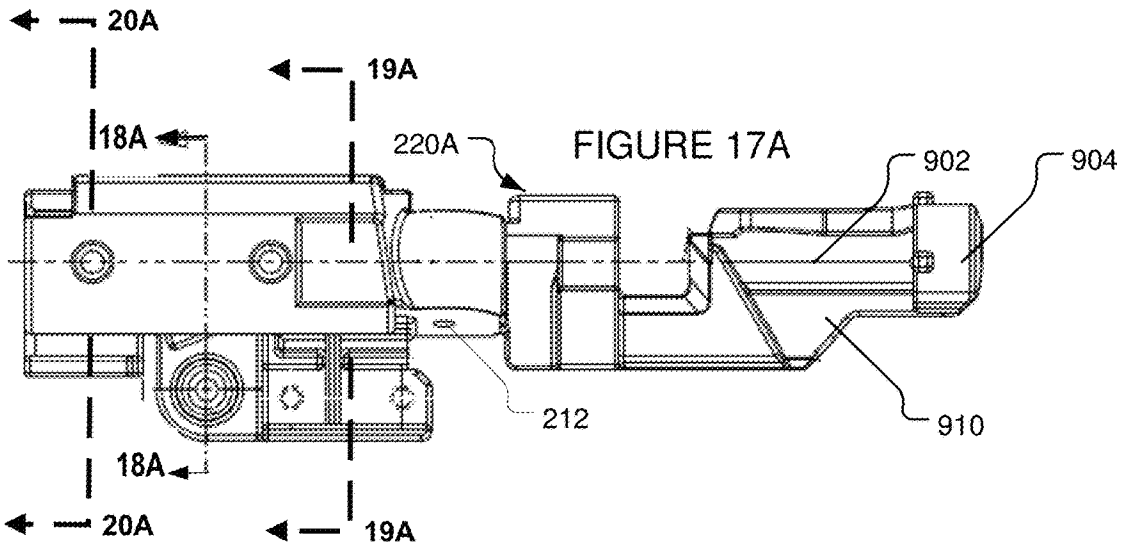
FIG. 17A is a top view the first embodiment of a second positioning jaw.
Figures 17B, 18B, 19B, 20B:
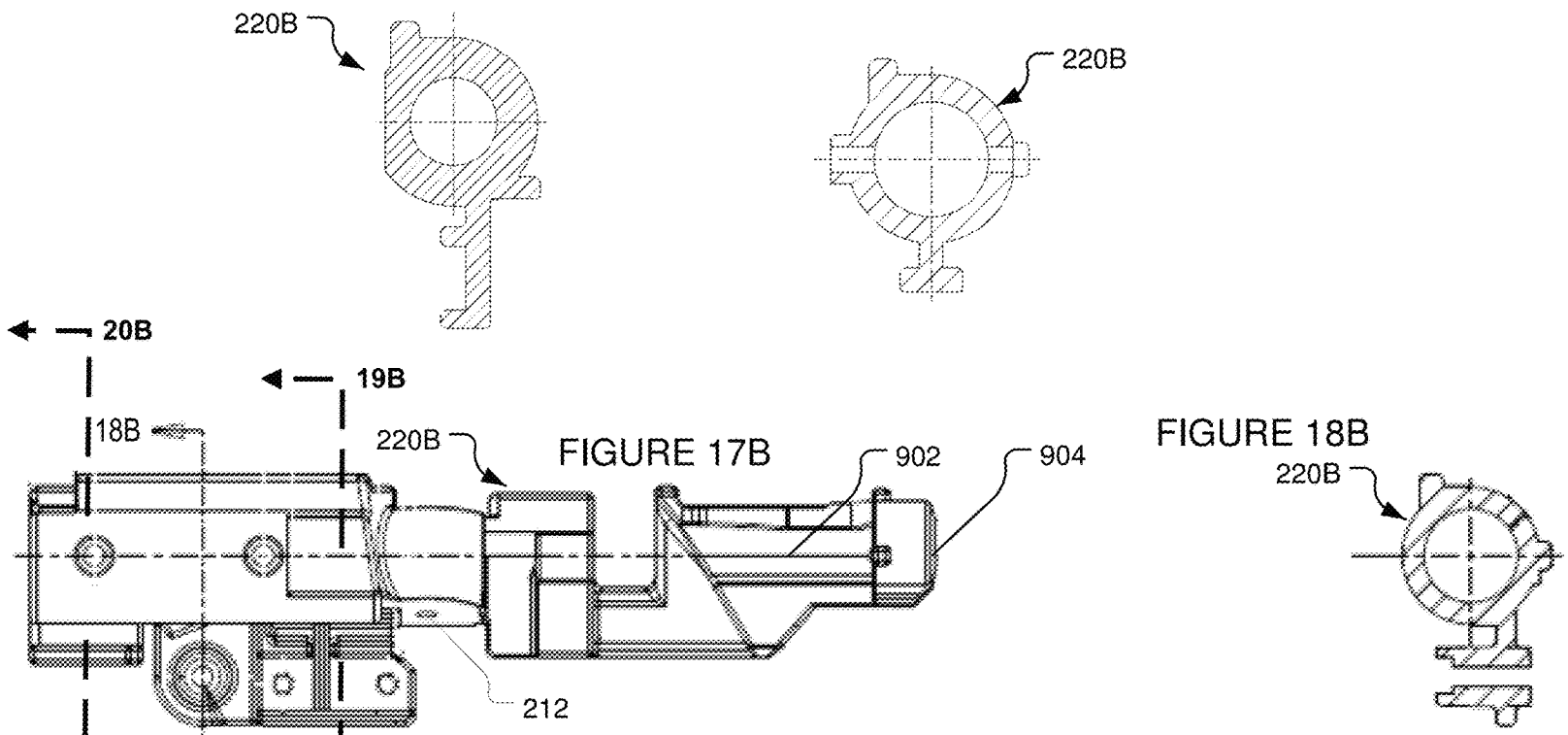
FIG. 17B is top side view the second embodiment of a second positioning jaw.
FIG. 18B is a cross-sectional view along line 18B-18B in FIG. 17B.
FIG. 19B is a cross-sectional view along line 19B-19B in FIG. 17B.
FIG. 20B is a cross-sectional view along line 20B-20B in FIG. 17B.
Figure 22A:
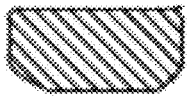
FIG. 22A is a cross-sectional view along line 22A-22A in FIG. 23A.

As illustrated in FIGS. 2B and 2C, a portion of the fastener strip 12 (not shown in FIG. 2B, 2C) holding a fastener will enter channel strip 865 and pass through the assembly 200, with a fastener-less portion of the strip being ejected out the other side of assembly 200. As each fastener in the strip moves (into the page) into the assembly between jaws 210, 220, jaw 210 opens and captures a fastener between the jaws, positioning the fastener in a guide channel 202. A collation shelf 870 stops movement of the fastener. As discussed below, a collation shelf 970 is positioned on jaw 220B in the second embodiment of the technology.

FIGS. 3A-23A show a first embodiment of the jaws 210, 220, designated 210A and 220A. FIGS. 3B-23B show a second embodiment of the jaws 210, 220 designated 210B and 220B. The primary difference between the two embodiments is the location of the collation shelf. In the embodiment of FIGS. 3A-23A, the collation shelf is positioned on jaw 210A, while in the embodiment of 3B-23B, the collation shelf is positioned on the jaw 220B.

FIGS. 3A through 23A show various features of the jaws 210, 220 in the placement assembly 200. As discussed below, the placement assembly is designed to ensure that the fastener exiting the tool is aligned in three dimensions on axis so that it enters the work piece at the location desired by the user. In this respect, the placement assembly 200 maintains the position of the fastener in x and y axis directions (generally in plane to the workpiece into which the fastener is being driven, although it should be understood that the workpiece need not be totally planar), and secures the fastener between the jaws, as a result of the features discussed below. The fastener is driven in the z axis direction relative to the workpiece With primary reference to FIG. 3A, jaw 210 includes a channel 805 for receiving the collated fastener strip. Channel 805 makes up one half of the guide channel 202. The feed pawl carrier assembly advances fastener s on a fastener strip toward two closed jaws 210A, 220A. Each jaw has an outer surface and an inner cavity (Surface 805 on jaw 210A and surface 902 on jaw 220A). Jaw 210 has an inner cavity defined by an upper arcuate wall 415 and further defined by a series of inner walls 830, 840, 880 which creates a feed sub-channel 855. The arcuate wall 415 defines angled edges 820 and 850.

An entry panel 860 is positioned at an angle relative to the entering fastener and the opposing jaw 220. The entry panel provides guidance to the fastener as the fastener strip including fasteners is moved into the channel 865 formed between the jaws. Both the embodiments of FIGS. 3A-23A and 3B-23B include this feature.

A collation shelf 870 is positioned adjacent to a channel 865 through which the fastener strip passes after depositing fastener s into the feed channel 855. In the embodiment of FIGS. 3A-23A, the collation shelf is formed on jaw 210A. In the second embodiment illustrated in FIGS. 3B-23B, the collation shelf 970 is positioned on jaw 220B rather than on jaw 210B.

Jaw 210A, 210B rotate about a rotational axis formed by pin 215 passing though bores 212,214 of respective jaws 220A, 220B. Each jaw includes a plurality of engagement surfaces 882, 884 (on jaw 210A, 210B) and surfaces 912, 910 on jaws 220A and 220B. Surface 882 engages surface 912 and surface 884 engages surface 910 when in the closed position illustrated in FIG. 2B.

Figure 23A:
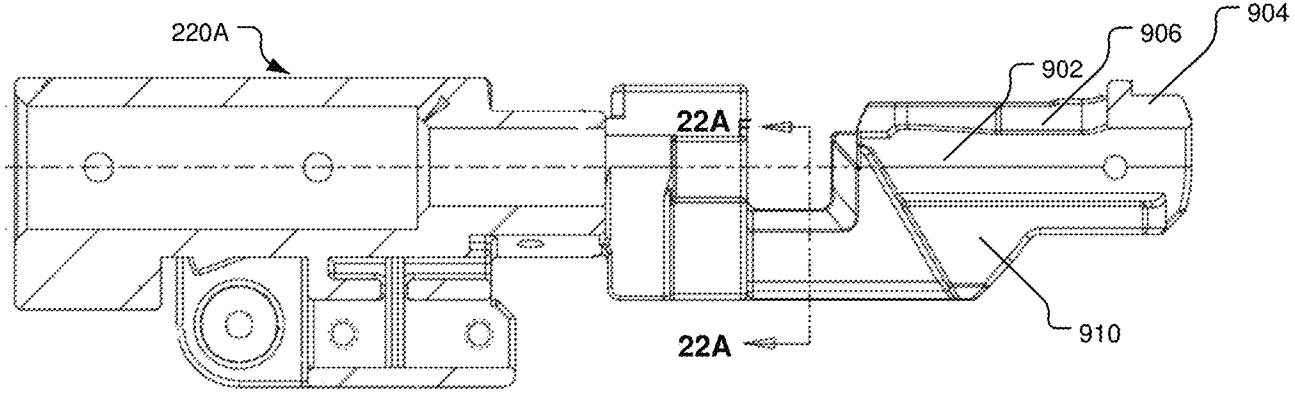
Figure 23C:
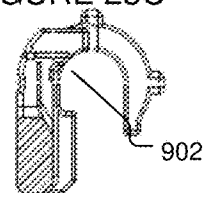
FIG. 23C is a cross section along line 23*c*-23*c* in FIG. 21A.
Figure 21A:
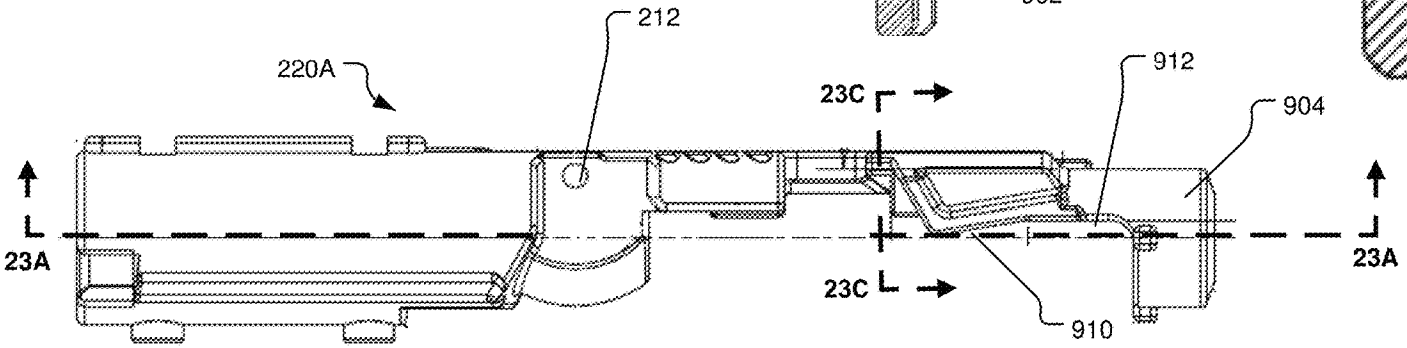
FIG. 21A is another side view the first embodiment of a second positioning jaw.
Figure 21B:
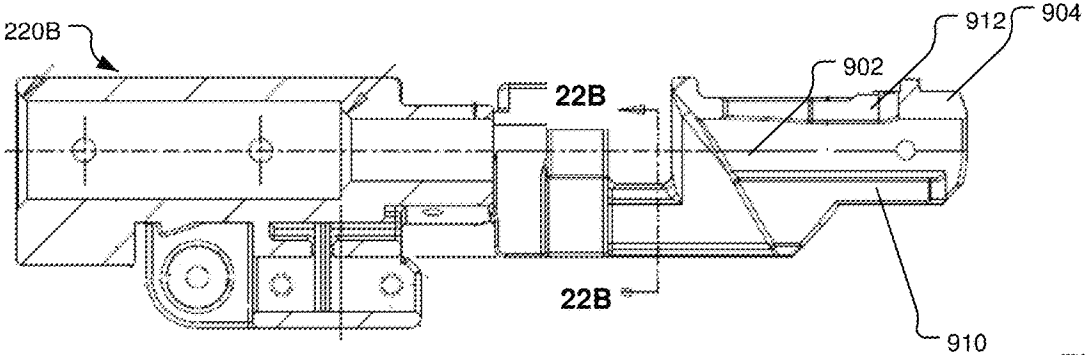
FIG. 21B is another side view the second embodiment of a second positioning jaw.
Figure 22B:
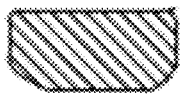
FIG. 22B is a cross-sectional view along line 22B-22B in FIG. 22B.
Figure 23D:
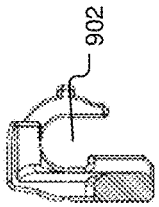
FIG. 23D is a cross section along line 23*d*-23*d* in FIG. 23B.
Figure 23B:
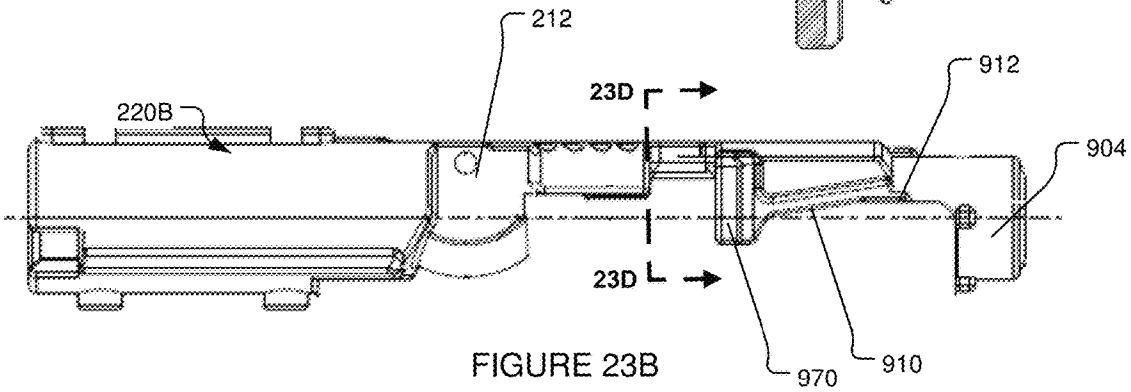

Jaws 210A, 210B and jaws 220A, 220B include opposing channels that define a fastener guide channel to position a fastener at the output of the tool. The channel 902 in jaws 220A, 220B has an arcuate cross section, as illustrated at FIGS. 23C and 23D.

The channel in jaws 210A and 210B is designed to capture and retain a fastener as the jaw is forced outward about rotational axis of pin 215 and maintained in contact with the fastener entering the assembly by the tension of spring 230. As may be noted in FIGS. 3A, 3B and 3C, the channel is formed by upper arcuate wall 415, and inner walls 830, 840, 880 which create a feed sub-channel 855. The arcuate wall 415 defines angled edges 820 and 850. Wall 830 is longer (vertically) than wall 840. Wall 830 acts as a stop to capture the fastener as the fastener enters the assembly (from right to left in FIGS. 3A and 3C).

Wall 830 is slightly angled (see FIGS. 8A and 8B) as is wall 840 to allow a fastener into sub-channel 855. Wall 840 is less angled than wall 830 (FIGS. 8A, 8B) with respect to an axis A normal to wall 880, and acts as a reverse stop, preventing the fastener and fastener strip from moving backwards. As the fastener is driven toward the workpiece (from top to bottom in FIGS. 3A and 3C), the arcuate and angled wall 415 may ensures that the fastener head remains centered into the channel to allow the fastener to exit the assembly.

The technology encapsulates the fastener within the channel 202 to prevent the fastener from exiting the channel and the tool accurately positions a fastener in the channel as the fastener is caused to exit the channel by downward pressure on the power driver 150 and the assembly 120.

Figure 24:
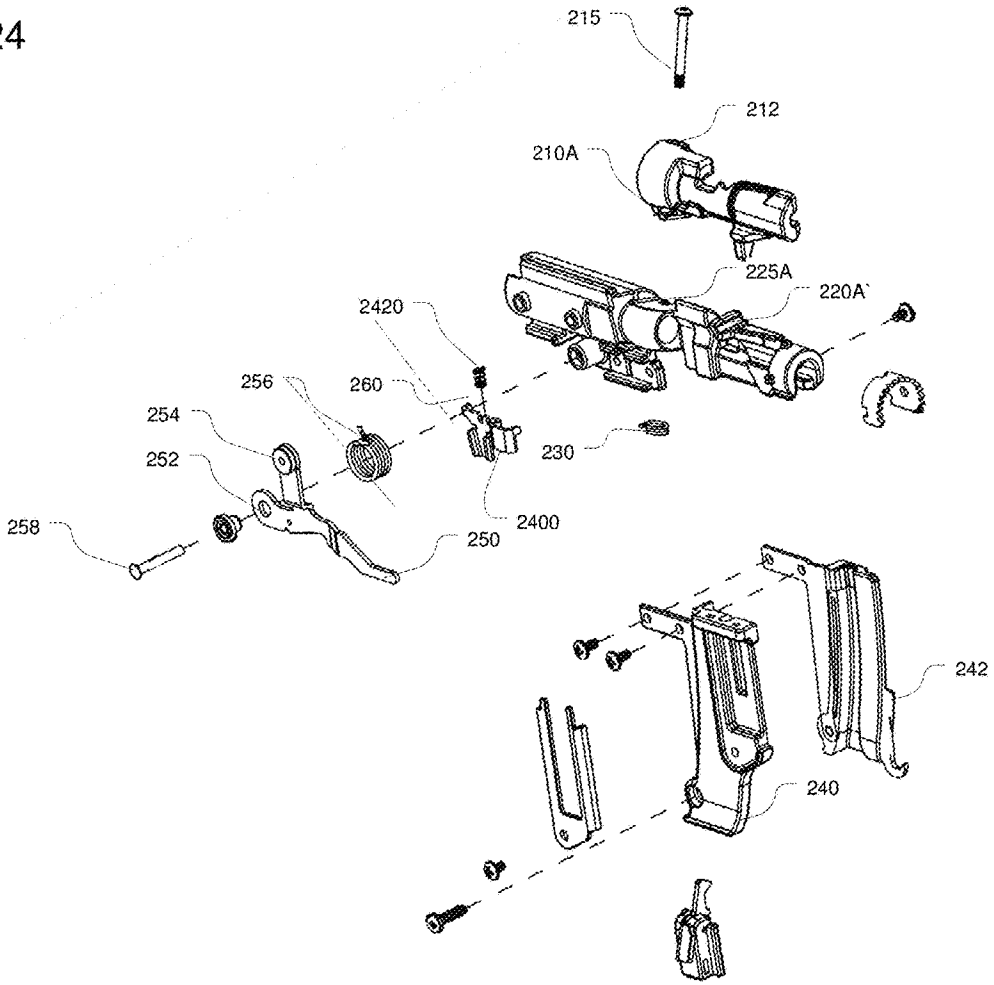
FIG. 24 is a partial, exploded assembly view of a second embodiment of the guide tube assembly incorporating a locking member.

FIGS. 24-29 illustrate another embodiment of the present technology wherein a locking member 2400 is utilized to ensure that arm jaw 210 (210A, 210B) stays open when a fastener is advanced into the channel prior to fastener driving. FIG. 24 is a partial, exploded assembly view of a second embodiment of the guide tube assembly incorporating a locking member 2400. The locking member 2400 is positioned between the lever 250 and the body of jaws 210A and 225A (or 210B and 225B).

Figure 25:
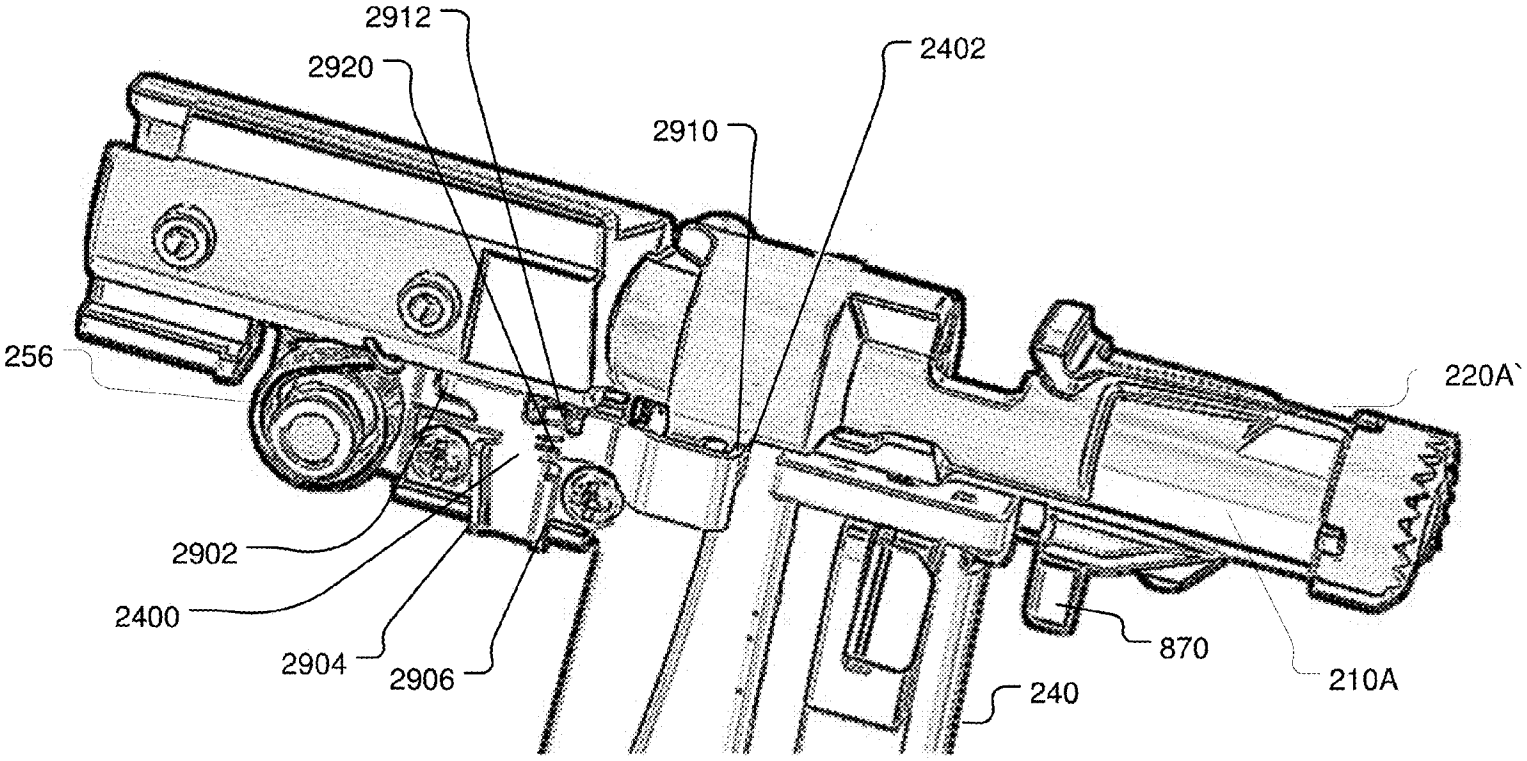
FIG. 25 is a partial perspective view of the guide tube assembly illustrating the locking member.

FIGS. 29A-29D illustrate the locking member 2400. Tab 2400 includes an engagement tab 2910 which engages a clearance pocket 2402 in jaw 210 as illustrated in FIG. 25. On the opposite side of the locking member is a pivot tab 2902 which rests in a slot in jaw 225 (225*a*, 225*b*). Tab 2400 includes a generally trapezoidal shaped projection 2905 having two angled spacers 2904 and 2906 positioned in opposing relation to the direction of pivot tab 2902. An engagement tab 2910 is positioned on extension region 2914. The extension region 2914 is formed to allow the locking member 2400 to freely rotate about the pivot tab 2902 without interference from the structure of the fastener strip guide rail 240, and position the locking tab 2910 to engage a clearance pocket 2402 in jaw 210. The locking member 2400 rotates about the pivot tab 2902 between a position where the engagement tab 2910 enters the clearance pocket 2402 on jaw 210A, 210B, and a rotated, locked position (FIGS. 25 and 27) where the engagement tab 2910 is forced out of the clearance pocket 2402 by the force of spring 2912 and into a "pinch point" between the jaw 210 and a portion of the guide rail 240.

Figure 26:
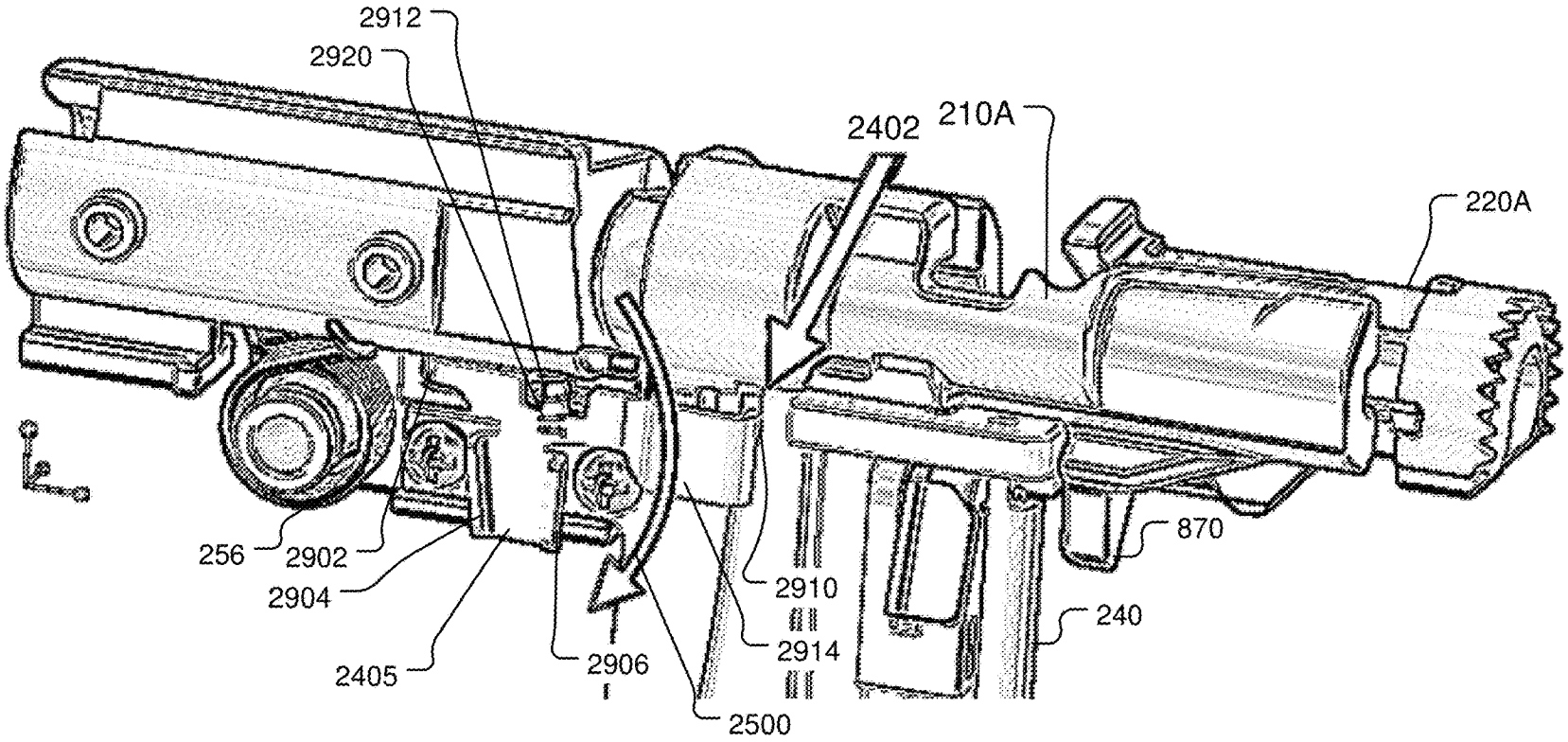
FIG. 26 is a partial perspective view of the guide tube assembly illustrating the locking member.
Figure 27:
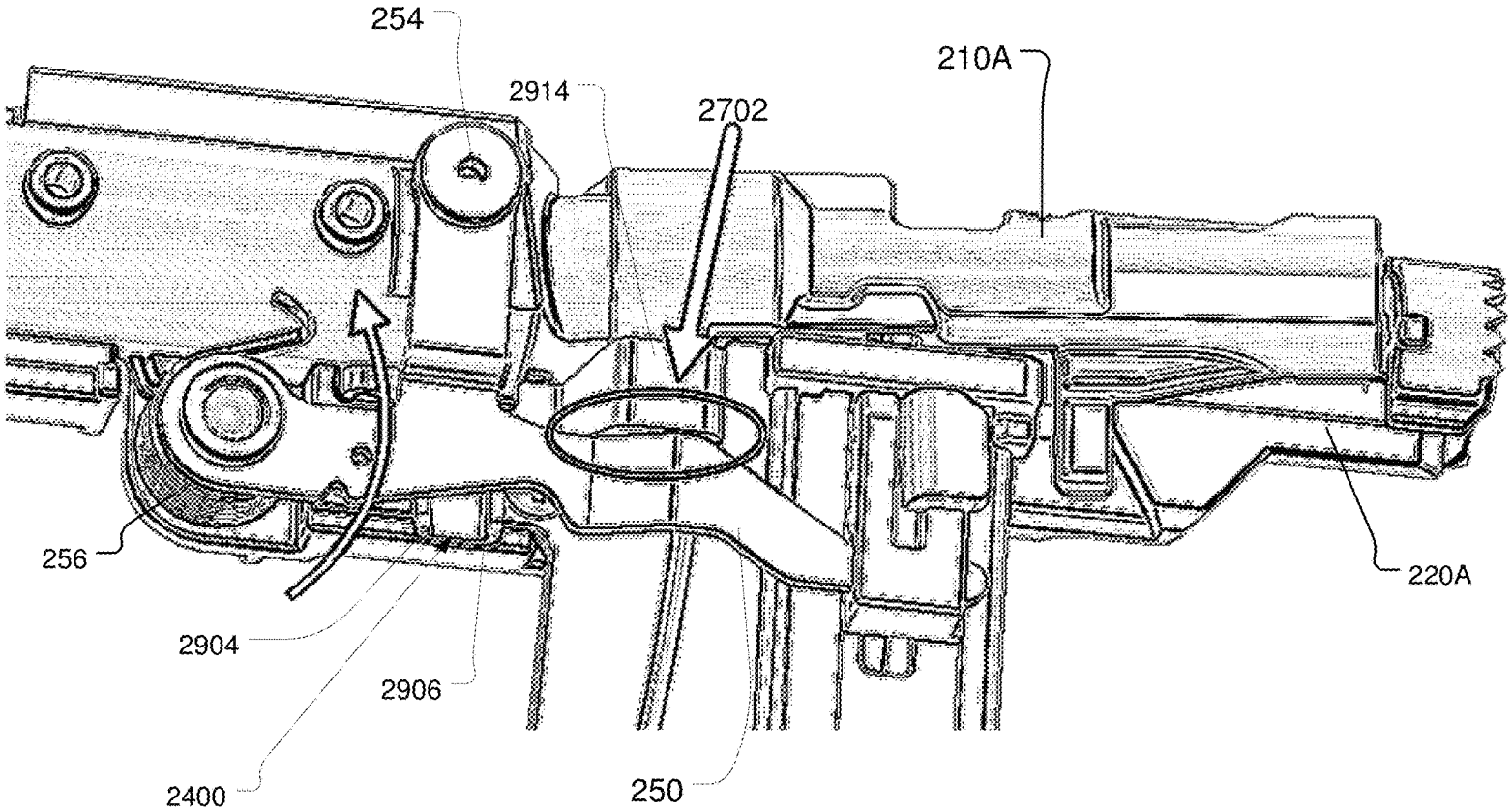
FIG. 27 is a partial perspective view of the guide tube assembly illustrating the locking member.
Figure 28:
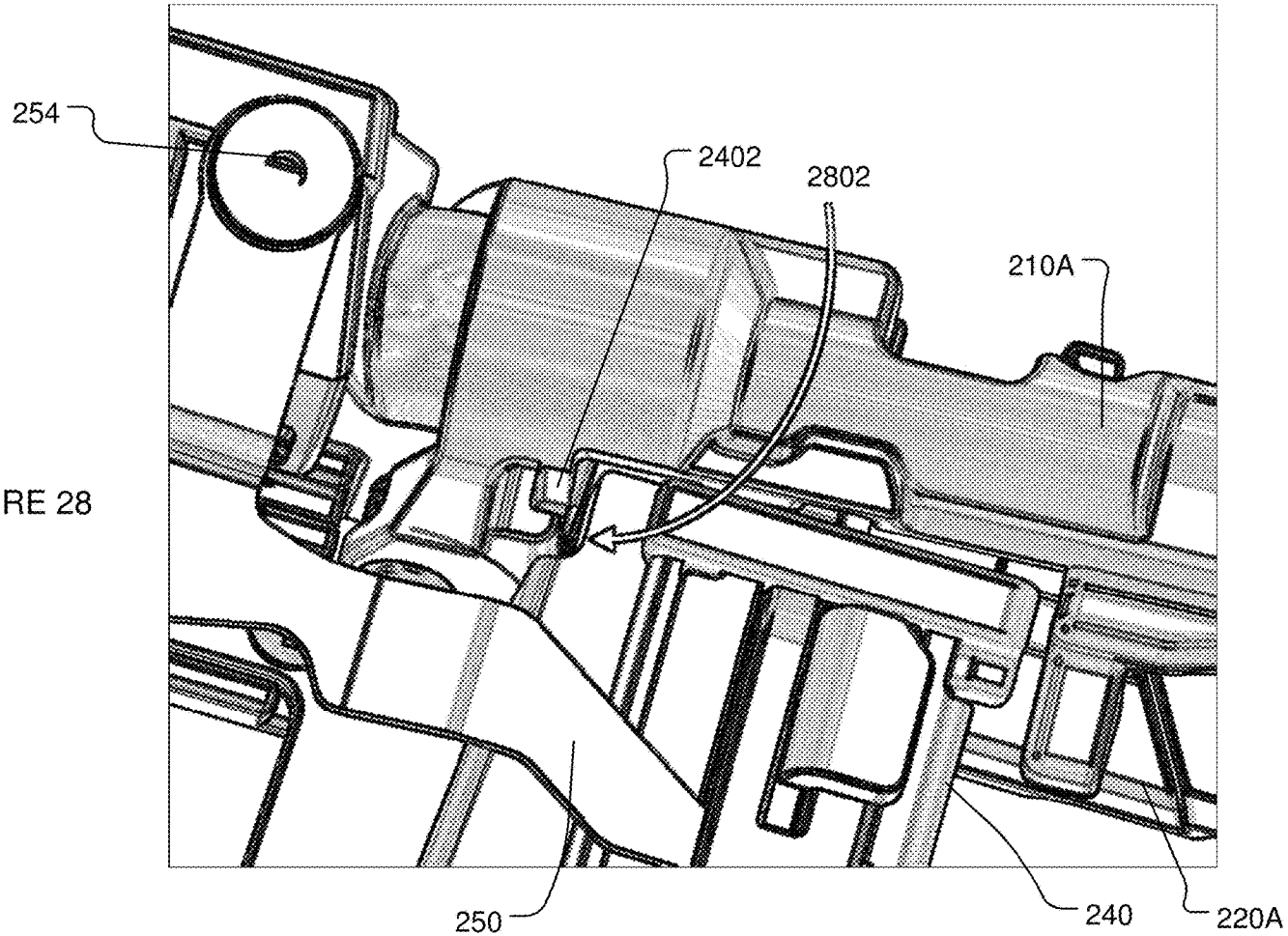
FIG. 28 is a partial perspective view of the guide tube assembly illustrating the locking member.
Figure 29A:
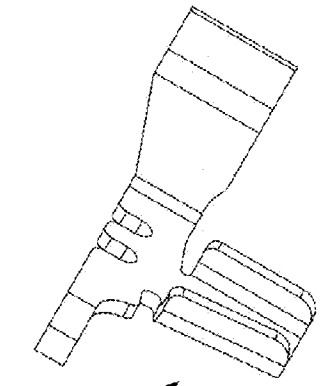
FIG. 29A is perspective view of the locking member along the view line 29A-29A illustrated in FIG. 29B.
Figure 29B:
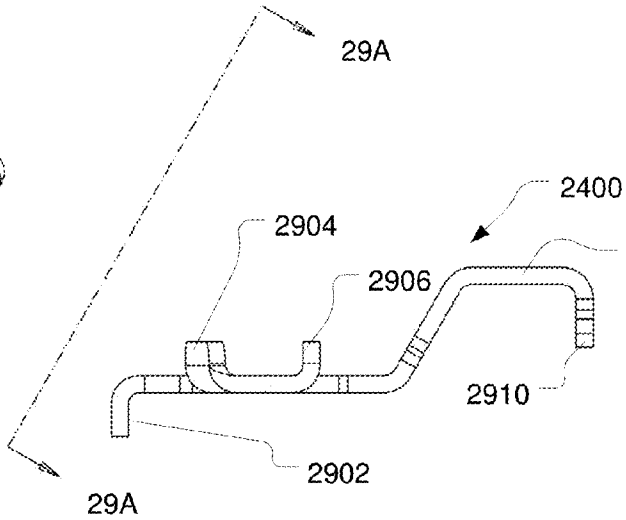
FIG. 29B is a bottom view of the locking member.
Figure 29C:
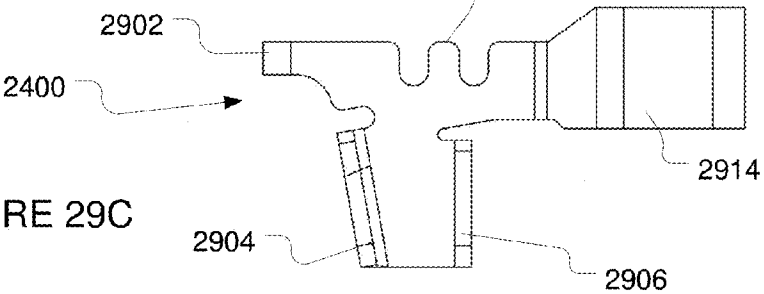
FIG. 29C is a plan view of the locking member.
Figure 29D:
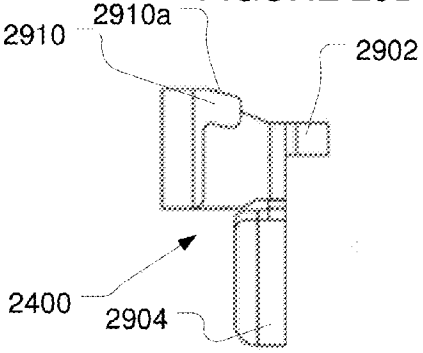
FIG. 29D is an end view of the locking member.

FIGS. 25-28 illustrate operation of the locking member 2400. FIG. 25 shows the locking member 2400 in a position where 210 jaw is closed and engaged with jaw 225. In FIG. 25, the feed lever 250 is not shown for clarity in illustrating the position of the locking member 240. FIG. 26 illustrates rotation of the locking member 2400 as jaw 210 opens (and feed lever stokes away from jaw 210, not illustrated, to bring the next fastener into the channel). FIG. 27 illustrates the feed lever 250 returning from the end of its stroke, pushing the locking member 2400 out of its pinched state. FIG. 28 is an enlarged view of the pinch point.

With reference to FIGS. 25-28, positioning of the locking member 2400 is based on movement of the lever 250, jaw 210 and a spring 2920. The spring 2920 engages a spring tab 2912 on the locking member 2400 and a surface of jaw 225. When jaw 210 is closed (engaged with jaw 225), the engagement tab 2910 rests in the clearance pocket. When the feed lever 250 is in a position where the lever has moved a fastener on the strip into the channel, and is generally parallel length of the jaw 210, the locking member is retained in the position shown in FIG. 25 against the force exerted by spring 2920.

When the feed lever 250 strokes away from the jaw 210 (in the direction of arrow 2500 in FIG. 26) and jaw 210 opens to allow a fastener into the inner channel, the locking member 2400 under the force exerted by spring 2920 moves such that the engagement tab 2910 is forced out of the clearance pocket 2402 and the locking member 2400 to rotates in the direction of arrow 2500 to position engagement tab 2910 into a pinch point 2802 (FIG. 28), locking the jaw 210 open until the feed lever 250 moves on its return stroke. As the feed lever moves back toward jaw 210, as it reaches the end of its return stroke, the feed lever 250 pushes the locking member 2400 out of its pinched state, allowing the jaw 210 to close, and the engagement tab to return to the clearance pocket 2402. FIG. 28 illustrates the pinch point between the jaw 210 and the guide track 240. Note that the locking member 2400 is not fastened to either the assembly except by positioning of the pivot tab 2902 and is retained in position by the feed lever 250. The angled spacers on projection 2905 are angled such that the feed lever 250 engages the spacers to push locking member 2400 upward (toward jaw 210) and engagement tab 2910 into the clearance pocket 2402.

It should be recognized that the particular structure of the locking member may be modified to provide other forms of a locking member which provide an engagement tab, pivot tab or other pivot point, and While the technology is shown as utilized with a collated fastener strip, an automatic feeding mechanism for fasteners is not a critical component of the technology described herein. The positioning assembly may be utilized with numerous types of fasteners and fastening systems.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A guide assembly for an apparatus for driving a threaded fastener, comprising:

a first jaw and a second jaw, the first jaw fixed to a driver guide tube, the second jaw attached to the first jaw to allow one end of the second jaw to rotate away from the first jaw about a rotational axis, each jaw having an interior channel, the interior channel of the first jaw and the second jaw forming a guide channel, the interior channel of the first jaw having an arcuate cross-section, the interior channel of the second jaw formed from a plurality of walls including an arcuate upper wall formed at an angle relative to the longitudinal axis, a sub-channel having cross-section formed by a base surface and two side walls, each side wall angled with respect to the base surface.

2. The apparatus of claim 1 further including a collation shelf on the first jaw or the second jaw.

3. The apparatus of claim 1 further including a strip guide housing, and a locking member configured to engage the second jaw when the second jaw is rotated away from the first jaw and retain the second jaw in a rotated position.

4. The apparatus of claim 3 the locking member engages the strip guide housing and the second jaw at a pinch point.

5. The apparatus of claim 4 wherein locking member includes an engagement tab and a pivot tab, the pivot tab formed on a first end of the locking member and positioned in an opening on the first jaw, the pivot tab extending from the locking member in a first direction, the engagement tab formed on a second end of the locking member and in the first direction.

6. The apparatus of claim 5 further including a spring positioned between the locking member and the first jaw.

7. The apparatus of claim 1 wherein the arcuate upper wall terminates on a first side and a second side of the interior channel of the second jaw, and the arcuate wall defines angled edges at the first side and the second side.

8. The apparatus of claim 1 wherein a first of said two side walls is shorter than a second of said two side walls.

9. The apparatus of claim 1 wherein each of said two side walls forms an angle with an axis normal to the longitudinal axis, and a first of said two side walls forms an angle larger than an angle formed by a second of said two side walls.

10. An apparatus for driving a threaded fastener, comprising:

a driver guide tube having a first end;

an elongated driver shaft in the guide tube having a rear end coupled to a power driver and a forward end adapted to carry a bit, the driver shaft defining a longitudinal axis;

a positioning assembly having a first jaw and a second jaw, the first jaw fixed to the driver guide tube, the second jaw attached to the first jaw to allow one end of the second jaw to rotate away from the first jaw about a rotational axis, each jaw having an interior channel; and a locking member configured to engage the second jaw when the second jaw is rotated away from the first jaw and retain the second jaw in a rotated position.

11. The apparatus of claim 10 wherein the apparatus includes a strip guide housing and the locking member engages the strip guide housing and the second jaw at a pinch point.

12. The apparatus of claim 11 wherein locking member includes an engagement tab and a pivot tab, the pivot tab formed on a first end of the locking member and positioned in an opening on the first jaw, the pivot tab extending from the locking member in a first direction, the engagement tab formed on a second end of the locking member and in the first direction.

13. The apparatus of claim 11 further including a spring positioned between the locking member and the first jaw.

14. The apparatus of claim 10 wherein the interior channel of the first jaw has an arcuate cross-section, the interior channel of the second jaw formed from a plurality of walls including an arcuate upper wall formed at an angle relative to the longitudinal axis, a sub-channel having cross-section formed by a base surface and two side walls, each side wall angled with respect to the base surface the arcuate upper wall terminates on a first side and a second side of the interior channel of the second jaw, and the arcuate wall defines angled edges at the first side and the second side.

15. The apparatus of claim 14 wherein a first of said two side walls is shorter than a second of said two side walls.

16. The apparatus of claim 15 wherein each of said two side walls forms an angle with an axis normal to the longitudinal axis, and a first of said two side walls forms an angle larger than an angle formed by a second of said two side walls.

17. A positioning assembly for a driving system, comprising a first jaw and a second jaw, the first jaw fixed to the driving system, the second jaw attached to the first jaw to allow one end of the second jaw to rotate away from the first jaw about a rotational axis, each jaw having an interior channel;

the interior channel of the first jaw having an arcuate cross-section, the interior channel of the second jaw formed from a plurality of walls including an arcuate upper wall formed at an angle relative to the longitudinal axis, a sub-channel having cross-section formed by a base surface and two side walls, each side wall angled with respect to the base surface; and a locking member configured to engage the second jaw when the second jaw is rotated away from the first jaw and retain the second jaw in a rotated position.

* * * * *